United States Patent [19]

Gamble

[11] 4,085,988

[45] Apr. 25, 1978

[54] BUS DUCT PLUG-IN GROUND STAB

[75] Inventor: Dennis H. Gamble, Brighton Township, Beaver County, Pa.

[73] Assignee: Westinghouse Electric Corporation, Pittsburgh, Pa.

[21] Appl. No.: 763,202

[22] Filed: Jan. 27, 1977

[51] Int. Cl.[2] ..... H01R 3/06

[52] U.S. Cl. ..... 339/14 R; 339/22 B; 339/154 R; 339/258 P

[58] Field of Search ..... 339/14 R, 14 L, 14 P, 339/22 B, 154 R, 258 P

[56] References Cited

U.S. PATENT DOCUMENTS 3,213,403 10/1965 Herrmann et al. ..... 339/22 B 3,213,405 10/1965 Weimer et al. ..... 339/154 R 3,439,309 4/1969 Giger, Jr. et al. ..... 339/22 B

*Primary Examiner*—Roy Lake

*Assistant Examiner*—DeWalden W. Jones

*Attorney, Agent, or Firm*—L. P. Johns

[57] ABSTRACT

A multi-phase electrical power distribution apparatus characterized by a section of bus duct having a plurality of multi-phase bus bars supported therein, a ground bar within the bus duct, an insulated outlet opening in one wall of the bus duct, a plug-in unit detachably mounted on the bus duct and having electrically conductive means extending through the opening and attached to the bus bars, and a ground conductor extending through the opening and being detachably connected to the ground bar.

5 Claims, 4 Drawing Figures

BUS DUCT PLUG-IN GROUND STAB

CROSS REFERENCE TO RELATED APPLICATIONS

This invention is related to the inventions disclosed in the applications to Dennis H. Gamble, Ser. No. 748,793, filed Dec. 9, 1976 and Ser. No. 763,201, filed Jan. 27, 1977.

BACKGROUND OF THE INVENTION

1. Field of the Invention

This invention relates a bus duct having a plug-in power take-off outlet means.

2. Description of the Prior Art

Bus ducts of prior construction having plug-in power take-off units have not been provided with grounding connections between the plug-in unit and the bus duct. For that reason it has been necessary that suitable grounding means be provided when the plug-in unit is installed. As a result, the attachment and detachment of a plug-in power take-off unit on bus ducts has involved the problem of adding and subsequently removing the ground means.

SUMMARY OF THE INVENTION

In accordance with this invention, it has been found that the foregoing problem may be overcome by providing a multi-phase electrical power distribution device comprising a section of bus duct having top and bottom walls and opposite side walls forming a housing, a plurality of multi-phase bus bars supported within the housing, a ground bar within the housing, one of the walls having an outlet opening, a plug-in unit detachably mounted on the bus duct, the plug-in unit being a box-like member having a bottom wall which includes an aperture aligned with the outlet opening when the plug-in unit is attached to the bus duct, the plug-in unit having electrically conductive means extending through the opening and detachably engaging the multi-phase bus bars, an electrically insulating member in the bus duct and aligned with the opening, the member having a number of hole means, the electrically conductive means extending through the hole means, ground conductor means within the housing and electrically connected to the plug-in unit and comprising a conductor extending through the hole means, and the ground conductor being a flexible member biased against and detachably contacting the ground bar in the bus duct.

The advantage of the device of this invention is that it provides automatically for means for grounding a bus bar and a plug-in power take-off unit when the latter is not in place, thereby saving time and material which would otherwise be spent providing such grounding means.

DESCRIPTION OF THE PREFERRED EMBODIMENTS

Figure 1:
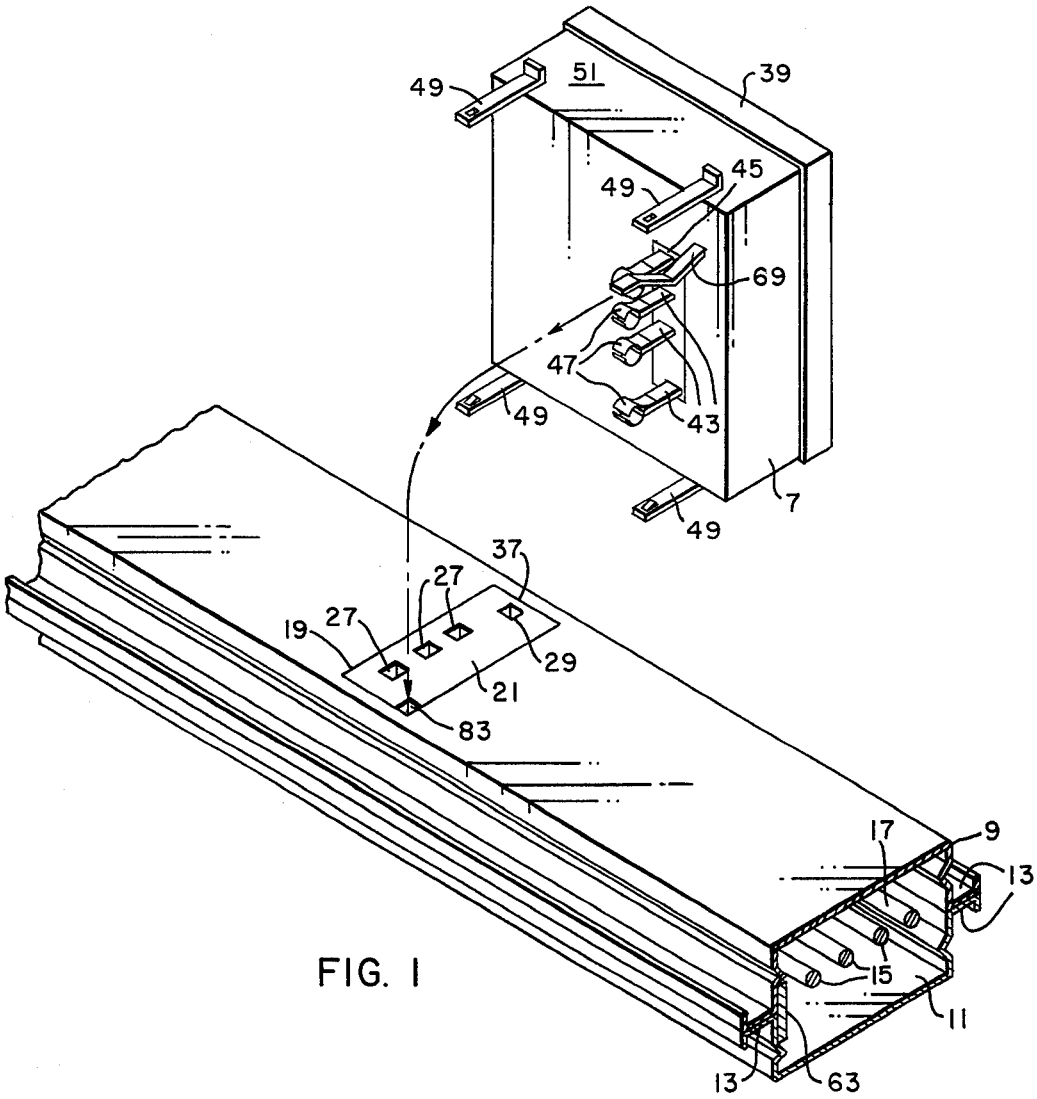
FIG. 1 is an isometric exploded view of a section of bus duct and a plug-in unit.

In FIG. 1 a bus duct section and a plug-in unit are generally indicated at 5 and 7, respectively. The section of bus duct 5 comprising a housing including a generally U-shaped upper part 9 and a similar lower part 11. The parts 9 and 11 are connected together at flange portion 13 at each of two opposite sides thereof by means of a plurality of rivets (not shown). Three phase-carrying bus bars 15 and a neutral bar 17 are supported within the housing in a generally parallel relationship by means of an insulating bus bar support member of the plug-in type generally indicated at 19 (FIG. 2).

The plug-in type bus bar support member 19 is a one-piece molded body of insulating material comprising (FIG. 2) an upper surface 21 on opposite end walls 23, and parallel side walls 25 (one of which is shown). Three spaced openings 27 are provided in the upper surface 21 (FIG. 1), and another opening 29 is provided in the surface which is offset from the openings 27. The support member 19 is substantially hollow except for three insulating barriers 31 that are molded integral with the body of the member. The barriers 31 are positioned within the support member between adjacent openings 27, 29. In addition, four grooves 33 are provided in each of the two opposite side walls 25 for receiving the bus bars 15 and the neutral bar 17, which extend through a support member 19. Four legs 35 are molded integral with the walls of the support member. The upper surface 21 of the member 19 is aligned with an aperture 37 in the top surface of the bus duct section 5.

Figure 2:
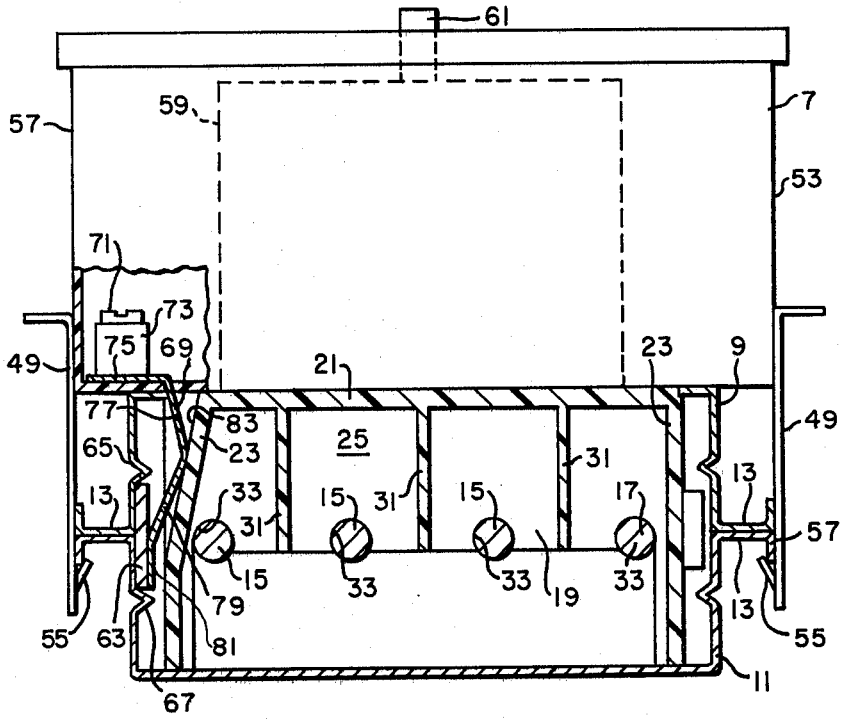
FIG. 2 is a vertical sectional view of the assembled plug-in unit and bus duct, taken on the line II—II of FIG. 1.

As shown in FIG. 2, whenever it is desirable to tap power off of the bus duct 5, the plug-in unit 7 is mounted on the bus duct housing on the upper part 9 over the support member 19. The plug-in unit 7 comprises a housing 39 having a cover 41 secured by suitable means which are not shown.

Three electrical connectors 43 of similar construction are supported by an insulating support 45 each of which connectors comprises clip-on type stabs 47. Similar clip-on stabs are provided for the neutral bar.

When the plug-in unit 7 is mounted in place on bus duct section 5, the electrical connectors including the clip-on members or stabs 47 extend through the insulating support member 19 and are clipped on the bus bars 15, 17 in a manner similar to that shown in U.S. Pat. No. 2,313,405. The plug-in unit 7 is supported on the bus duct housing upper part 9 by suitable means by similar brackets 49 which are secured to the opposite side walls 51, 53 of the unit 7. Each bracket 49 comprises an inturned ear 55 which engages the down-turned flange portion 57 (FIG. 2) of the lower part 11 of the bus duct section 5.

A three-pole circuit breaker generally indicated at 59 is provided within the plug-in unit 7 in a manner similar to circuit breaker disclosed in U.S. Pat. No. 2,313,405, which is incorporated as part hereof. The several electrical connectors 43 are part of and extend from the circuit breaker 59 in a manner well known in the art. A handle 61 is provided for permitting manual opening and closing of the contacts (not shown) of the circuit breaker to permit opening and closing of the three-phase circuit that is tapped off of the three-phase conducting bus bars 15.

In accordance with this invention, a ground bar 63 is mounted on the inner surfaces of the bus duct 5 formed by the upper and lower parts 9, 11. The ground bar 63 is preferably disposed between similar in-turned grooves 65, 67 formed in the side walls of the upper and lower parts 9, 11, respectively. The ground bar 63 is coextensive with each bus duct section 5. As shown in FIG. 1, a ground stab or conductor 69 is attached to the bottom wall of the plug-in unit in a suitable manner, such as a screw 71 (FIG. 2), and a ground terminal 73 which is preferably provided within the plug-in unit for connection through a suitable ground conductor (not shown). The upper end of the ground stab 69 includes a flange 75 which includes a square hole (not shown) to accept a square shank of the terminal 73 to prevent it from turning. The flange 75 is also lanced on its edges in order to provide sharp edges to cut through the enclosure finish on the plug-in unit 7 and to thereby assure good electrical contact between the ground stab 69 and the unit 7.

The ground stab 69 is comprised of a flexible or resilient metal having an out-turned portion 77 and an in-turned portion 79, the lower end of which is out-turned at 81 to facilitate insertion and good contact with the ground bar 63. In order to guide the ground bar 63 into the position shown in FIG. 2, that is, in contact with the ground bar 63, the upper surface 21 includes a hole or notch means 83, the end wall 23 of which is inclined downwardly and outwardly from the upper surface 21 to guide the lower end of the ground stab 69 into contact with the ground bar 63.

Figure 3:
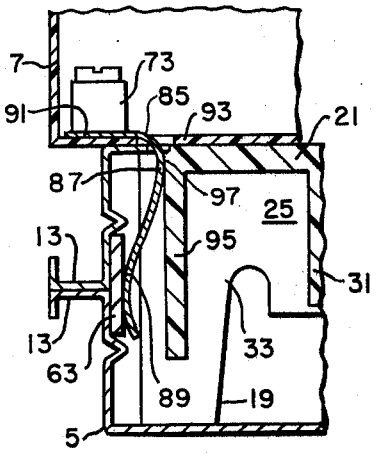
FIG. 3 is a fragmentary sectional view of another embodiment of the invention.

Another embodiment of the invention is shown in FIG. 3 in which similar numerals refer to similar parts corresponding to those of FIG. 2. More particularly, a ground stab 85 differs from the ground stab 69 (FIG. 2), in that the former includes an upper arcuate portion 87 and a lower arcuate portion 89. The upper end of the stab 85 includes a flange 91 disposed within the plug-in unit 7 and extending through an aperture in the bottom wall 93 thereof. An end wall 95 extends substantially at right angles from the upper surface 21 of the support member and thereby differs from the end wall 23 (FIG. 2) which is inclined at an angle to said upper surface. The end wall 95 contacts an upper arcuate portion 87 at 97 as the plug-in unit 7 is lowered into place. Thus the lower arcuate portion 89 of the ground stab 85 is held against the ground bar 63 in good electrical contact.

Figure 4:
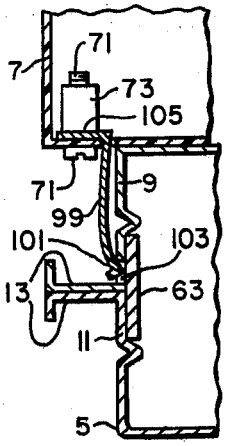
FIG. 4 is a fragmentary sectional view of another embodiment of the invention.

Another embodiment of the invention is shown in FIG. 4 in which a ground stab 99 is disposed externally of the bus duct section 5. The ground stab 99 differs from the ground stabs 69 and 87 in that the ground stab 99 extends along the external portion of the upper part 9 of the bus duct and a lower in-turned portion 101 extends through a hole 103 in the upper part 9 where the in-turned portion engages the ground bar 63. Like the ground stabs 69, 85, the stab 99 includes an out-turned flange 105 which is secured to the bottom wall of the plug-in unit 7 by the ground terminal 73 and the screw 71.

In conclusion, the device of this invention provides a built-in ground means whereby the plug-in power take-off unit comprises a ground stab that is secured to the housing of the unit and extends through an opening in the unit and into contact with a ground bar built into the bus duct section thereby eliminating the necessity of the customer-user of fashioning his own ground means.

What is claimed is:

1. A multiphase electrical power distribution apparatus comprising a section of bus duct including top and bottom walls and opposite side walls forming a housing, a plurality of multi-phase bus bars supported within the housing, a ground bar mounted on a side wall of the housing, one of the walls having an outlet opening, a plug-in unit detachably mounted on the bus duct, the plug-in unit being a box-like member having a bottom wall, the bottom wall including an aperture aligned with the outlet opening when the plug-in unit is attached to the bus duct, the plug-in unit having electrically conductive means extending through the opening and detachably engaging the multi-phase bus bars, ground conductor means within and electrically connected to the plug-in unit and comprising a flexible conductor extending through the opening, and the conductor being biased in detachable contact with the ground bar in the bus duct.

2. The apparatus of claim 1 in which an electrically insulating member is in the bus duct and aligned with the opening, the electrically insulating member having a number of hole means, and the electrically conductive means extending through the hole means.

3. The apparatus of claim 2 in which the flexible conductor extends through the hole means.

4. The apparatus of claim 3 in which the hole means comprises a wall inclined from the outer surface of the insulating member and inwardly toward the ground bar to hold the flexible metal member against the ground bar.

5. The apparatus of claim 1 in which the ground bar is located against one side wall of the bus duct, the side wall comprises a hole adjacent the ground bar, the conductor extends from the plug-in unit externally of the side wall, and the conductor being biased into the hole and in contact with the ground bar.

* * * * *